US005586703A

United States Patent [19]

Radar et al.

[11] Patent Number: 5,586,703

[45] Date of Patent: Dec. 24, 1996

[54] DUAL FIELD PACK

[76] Inventors: Elizabeth Radar; James R. Radar, both of 1215 Red Gum, Suite H, Anaheim, Calif. 92806

[21] Appl. No.: 451,858

[22] Filed: May 26, 1995

[51] Int. Cl.[6] ..... A45F 3/04

[52] U.S. Cl. ..... 224/601; 224/623; 224/637

[58] Field of Search ..... 224/215, 208, 224/214, 216, 224, 250, 257, 259, 260, 160, 148, 269, 226, 220, 252, 255, 254, 256

[56] References Cited

U.S. PATENT DOCUMENTS

| | | | |
|---|---|---|---|
| D. 302,073 | 7/1989 | Biggs | 224/260 |
| D. 312,726 | 12/1990 | Kline | D3/36 |
| 892,991 | 7/1908 | Hepworth . | |
| 1,601,624 | 9/1926 | Houghton . | |
| 3,322,312 | 5/1967 | Mitchell | 224/26 |
| 4,778,091 | 10/1988 | Barto | 224/211 |
| 5,067,643 | 11/1991 | McKinney | 224/215 |
| 5,289,959 | 3/1994 | Beeley et al. | 224/209 |
| 5,294,030 | 3/1994 | Jollivette | 224/255 |

*Primary Examiner*—David J. Walczak
*Attorney, Agent, or Firm*—Gene Scott Patent Law & Venture Group

[57] ABSTRACT

A double pack device having a two packs interconnected with a pair of shoulder strap means, the straps designed to be engaged over the shoulders of a wearer so that one of the packs hangs in contact with the front of the wearer while the other of the packs hangs in contact with the back of the wearer. Side strap means are provided by which to draw the packs into close contact with the wearer so that the packs do not slide or flap against the wearer's body. An improved strap connection is provided whereby the strap means are fastened to a pack enclosing means and not to the more fragile fabric of the pack itself.

17 Claims, 3 Drawing Sheets

DUAL FIELD PACK

BACKGROUND OF THE INVENTION

1. Field of the Invention

This invention relates generally to field packs and more particularly to an improved double field pack device that enables a wearer of the pack to carry a plurality of items, one pack hanging in contact with the back of the body and the other pack hangs in contact with the front of the body. More particularly, the invention improves on the prior art by including improved constructional features for assuring improved resistance to wear and tear.

2. Description of Related Art

Invention and use of pack devices is well known to the public, as they have been employed to carry a variety of items on the back of a wearer's body. The most popular of such pack devices are typically referred to as back packs. Back packs consist of a generally rectangular housing portion, most usually made of a fabric, designed to contain a plurality of items and two straps that are secured to the housing portion so as to form a pair of strap loops through which the arms are inserted. When properly positioned, each strap rests on one of the wearer's shoulders so that the pack hangs from the wearer's shoulders and is positioned in contact with the wearer's back.

Unfortunately, many problems are associated with pack devices carried exclusively on the back and shoulders. First of all, the heavier the load contained within the housing portion of the pack, the greater the strain placed on the wearer's shoulders and back. This excess strain frequently leads the wearer to assume a relatively hunched position in an attempt to alleviate the stress. However, not only is this detrimental to the person's posture, but it also ultimately leads to more rapid fatigue of the wearer's back and shoulders. Another problem with standard packs worn exclusively on the back, is that they cause shoulder soreness. Again, the greater the weight of the load within the pack, the more the pack pulls against the straps looped around the shoulders. Over an extended period of time, the straps may actually even cut into the wearer's skin. On the other hand, when the load contained within the housing portion is rather light, the straps tend to slide off the wearer's shoulders and the housing portion tends to slide across the back rather than remaining in a stationary position. This is not only annoying for the wearer, but it can also be hazardous, especially when the pack device is worn by a motorcyclist, for whom frequently readjustment of the pack while driving is both difficult and dangerous. Additionally, as the straps continually move back and forth over the shoulders, friction may cause a rash or other skin irritation. Finally, these pack devices are significantly limited in that the wearer's back and shoulders can endure only so much weight, thereby limiting both the size and carrying capacity of back packs.

There are several prior art carrying devices that attempt to utilize both the chest and the back of the wearer, thus overcoming some of the disadvantages of prior art pack devices designed exclusively for the back. For example, Beeley et al. U.S. Pat. No. 5,289,959 discloses an infant rescue vest for enabling a single person to carry more than one infant at a time. A plurality of pockets are located on the front and back of the rescue vest, each pocket containing a seat over which the infant straddles and a ventilation structure through which the infant breathes.

Blanche U.S. Pat. No. 1,601,624 discloses a mail carrying device with a track that encircles the waist of the wearer.

Two sacks are positioned on the track, one against the front of the user and one against the back. The sacks can be rotated on the track so that either of the two sacks may be brought to the front of the user's body and accessed.

Hepworth U.S. Pat. No. 892,991 discloses a fruit-picker's belt with a waist belt for encircling the waist and shoulder straps attached to the waist belt and fitting over the wearer's shoulders. A hook is provided at both the front and the back of the waist belt so that a basket may be hung from both the front and the back of the wearer.

Kline design U.S. Pat. No. 312,726 discloses a ski boot bag with two triangular packs interconnected with a single strap, the strap designed to be engaged over the wearer's shoulder so that one pack hangs against the front of the wearer's body and the other pack hangs against the back of the wearer's body.

Mitchell U.S. Pat. No. 3,322,312 discloses a load carrying frame to which numerous packs, sleeping bags and other gear can be attached, thus allowing gear to be carried on both the front and back of the wearer. The frame has a generally U-shaped structure and is designed to extend from the front of the wearer's hips, over the shoulders and to the back of the wearer's hips.

Barto U.S. Pat. No. 4,778,091 discloses a child carrying apparatus specifically designed for use in combination with a framed backpack having two vertically projecting main frame members. The device includes a primary strap unit having adjustable loops that are operatively attached to the vertically projecting main frame members and an auxiliary strap unit that cooperates with the primary strap unit to form a chair sling assembly that supports and suspends a child from the front of the wearer's body.

It is clear from the above described prior art, that the concept of a pack mounted on both the front and back of a wearer is not new. It is also clear that none of the above devices, and use in the present field, in general, provide an improved double or dual field pack of improved construction and having facility of specific accomodation for the tools required by a motorcylist when on an extended journey. The weight of such tools can be considerable, so that balancing the weight of such tools is necessary by the opposing pack, and the strain on conventionally constructed packs would soon tear or otherwise damage the pack material or the strap fastenings. This has been found to be the case in this field at this time. There is a need for an improved pack for use by motorcyclist.

The present invention fulfills these needs and provides further related advantages as described in the following summary.

SUMMARY OF THE INVENTION

The present invention is a double pack device with two separate packs interconnected with one another by strap means, the device thus designed to be worn with a shoulder strap means engaging the wearer's shoulders so that one pack hangs in contact with the frontal, chest area of the wearer's body, and the other back pack hangs in contact with the back of the body. Thus, it is a primary object of the invention to improve upon prior art, single container, back pack devices by providing two packs with interior storage areas, thus essentially doubling the carrying capacity of standard packs without doubling the strain placed on the back. In fact, the inventive new construction prevents rapid fatigue of the wearer's back by effectively disbursing the weight of a load between the front and back of the body.

The shoulder strap means preferably include a padding means positioned between the straps and the wearer's shoulders, thus preventing the straps from cutting into the wearer's skin. Additionally, a layer of padding is also preferably placed within each of the pack's infacing walls, so that the padding is positioned between the items contained in the pack and the wearer's body. Thus, it is an object of the present invention to be constructed so as to provide additional comfort for the wearer.

It is another object of the invention to be firmly secured to the wearer so as to be safe enough for wearing in traffic on a bicycle or motorcycle. To accomplish this, the invention includes side strap means which extend between the sides of the packs to draw the packs into close contact with the wearer so that they do not slide across or flap against the body. The side straps are preferably interconnected with a two-part snap-in attachment means which allows the straps to be conveniently engaged and released as needed. Additionally, the straps include a length adjusting means by which to loosen or tighten the packs against the body. For additional security, multiple sets of straps may be positioned on each side of the packs.

It is yet another object of the invention to be extremely versatile in that the packs can be constructed with a variety of different features in order to accommodate the particular needs associated with the intended use of the pack. Preferably, the packs are constructed of sturdy yet flexible material and are non-self-supporting. Light reflecting means are preferably positioned on the outer surface of the packs so as to call attention to the wearer at night or in inclement weather conditions. At least one of the packs preferably includes a pocket designed to contain a water bottle, thus providing the wearer with a ready supply of drinking liquid as needed. Additionally, one of the packs preferably includes a holding means by which to secure a plurality of items, such as tools necessary for motorcyle or bicylce maintainance.

Finally, it is an important and key object of the present invention to provide a pack device having improved construction so that the straps and fabric portions of the pack device are mutually secured in an improve and novel manner, such that extreme wear and tear of the device does not easily cause rupture or disassembly of the various parts of the invention.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a double pack device. In such drawings.

DETAILED DESCRIPTION OF THE PREFERRED EMBODIMENT

Figure 1:
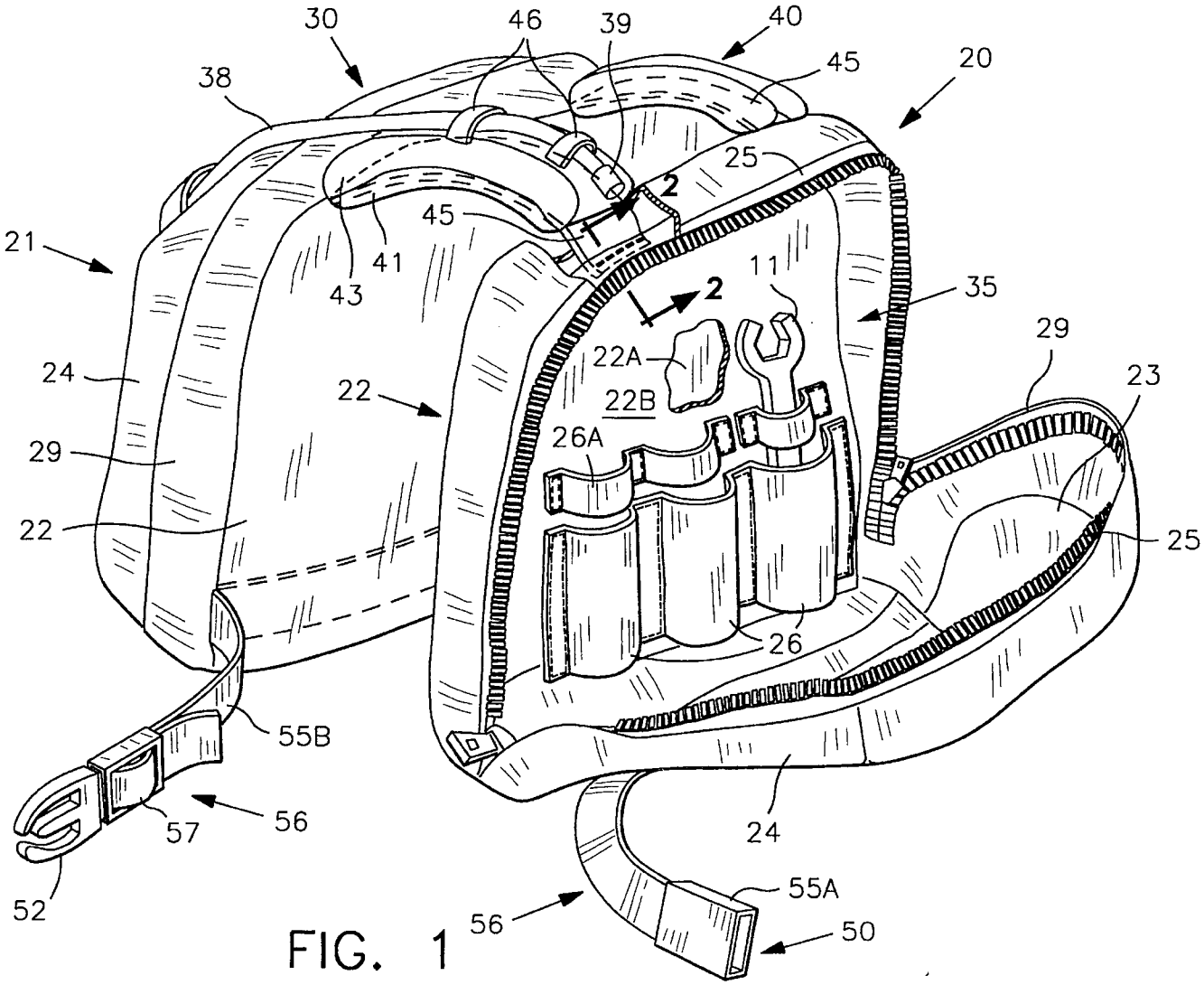
FIG. 1 is a perspective view of the preferred embodiment of the present invention, particularly showing pack interconnection means, tool holding means, and strap attachment means.
Figure 3:
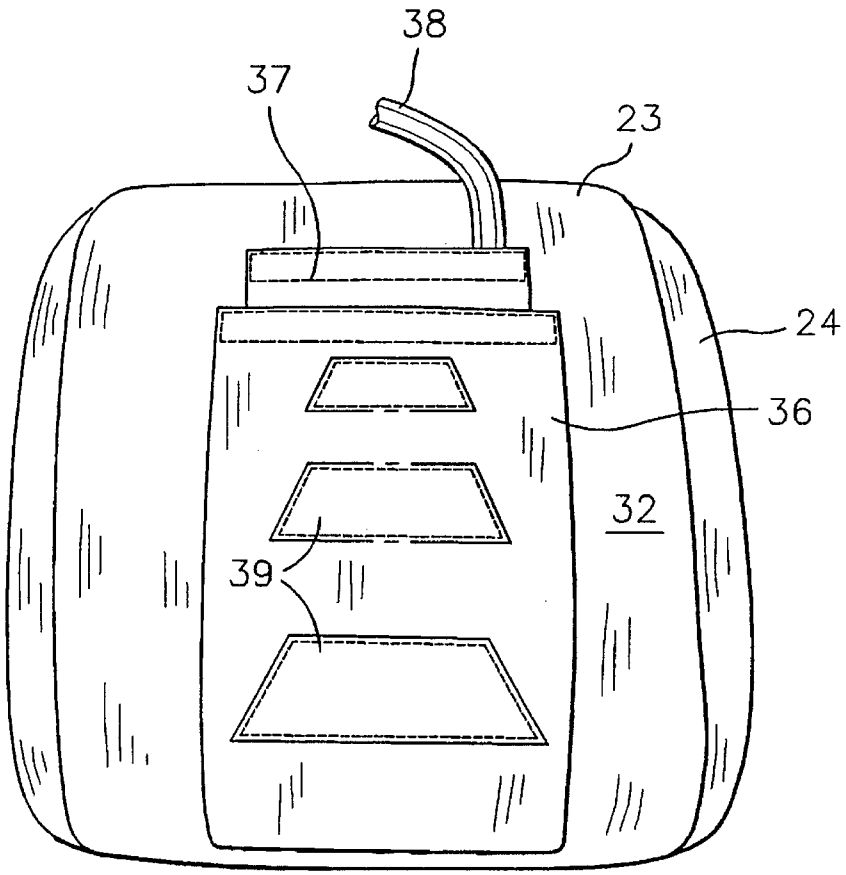
FIG. 3 is a rear elevational view thereof.
Figure 2:
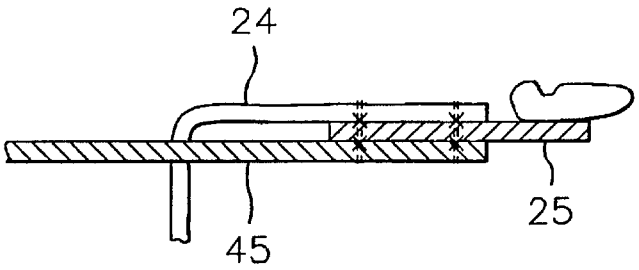
FIG. 2 is a cross sectional view thereof taken along line 2—2 of FIG. 1, particularly showing that the strap means is fastened directly to the pack closure means.

FIGS. 1–3 show a double pack device designed to be worn by a person (not shown). The double pack device is constructed so as to enable the wearer to carry a plurality of heavy items on both the front and back of the body.

The double pack device includes two packs, 20 and 30, interconnected to one another by shoulder strap means 40, the device thus is designed to be worn with the shoulder strap means 40 engaging a wearer's shoulders so that the front pack 20 hangs in contact with the frontal upper chest of the wearer's body while the back pack 30 hangs in contact with the upper back portion of the body. The double pack device is preferably constructed so that the two packs may be worn interchangeably, either pack able to be worn as the front pack 20, and likewise, either pack able to be worn as the back pack 30, depending on the wearer's personal preference. However, for purposes of clarity, the following description and corresponding figures will designate one of the packs the front pack 20, and one of the packs the back pack 30, although they are by no means limited to this arbitrary designation. The packs 20 and 30 are preferably of the same basic construction, although, if desired, they may be constructed with differing dimensions and constructional features, depending on the intended use of the double pack device.

Each of the packs 20 and 30 has an outer shell 21 constructed of a flexible, generally non-self-supporting material. It is essential that the construction material not only be flexible, but also lightweight, rugged and extremely durable. Additionally, the material is preferably either waterproof, or includes a waterproof coating so that the double pack device can be worn in all weather conditions. Such materials are well known in the field of back packs and in the present invention is preferably a nylon rip-stop type fabric. The outer shell 21 of each pack, 20 and 30, forms a proximal shell wall 22 and a distal shell wall 23 that define at least one interior space 35 between them. The distal shell walls 23 of the packs do not contact the wearer's body, while the proximal shell walls 22 of each pack are designed to contact the wearer's body. The proximal shell walls 22 preferably include a padding means 22A, preferably a layer of foam rubber or the like, by which to prevent items contained within the interior space 35 from scratching, poking or otherwise irritating the wearer. Including the padding means is especially desirable when the pack, 20 or 30, is designed to contain heavy, irregular shaped items such as tools 11.

As illustrated in FIG. 3, at least one light reflecting means 39 is preferably attached to an outer surface 32 of the distal shell walls 23 so as to alert motorists, hikers, or anyone else in close proximity to the wearer, of the wearer's presence. Preferably, as illustrated, the proximal and distal shell walls, 22 and 23, have a relatively rectangular shape, although they may also be constructed with a relatively square, oval, or other shape.

The distal and proximal shell walls 22 and 23 of each pack are spaced apart and connected to one another by a peripheral wall 24. The peripheral walls 24 of each pack conform generally to the shape of the distal and proximal walls. A partitioning wall not shown of approximately the same shape and size as the shell walls may be attached to the peripheral wall 24 so that it extends vertically between the proximal 22 and distal 23 walls, thus forming two separate interior storage spaces 35 within a single pack. Additional partitioning walls may be included to create a desired number of interior storage spaces 35 within each pack.

Each of the peripheral walls 24 has a separable enclosing means 25, which allows for quick access to the interior space of the pack 35. Preferably the enclosing means 25 is a zipper, although other similar, easily actuated enclosing means may also be utilized. As illustrated in FIG. 1, the enclosing means 25 preferably extends continuously along all portions of the peripheral edge 24 except the bottom portion, thus preventing the walls 22 and 23 from being completely separated from one another, and yet allowing full access to the entire interior space 35. The enclosing means 25 may be centered in the peripheral wall 24 between the two shell walls 22 and 23, as illustrated, or, alternately, it may be off-centered in the peripheral wall 24 so that it is closer to either the proximal 22 or the distal 23 wall. When the pack includes multiple interior spaces 35, a corresponding number of enclosing means 25 may be positioned in the peripheral wall 24, thus allowing access to each space 35 individually. A water-resistant, flexible flap 29 is preferably positioned over the enclosing means 25. The flap 29 is normally positioned so as to overlap the enclosing means 25 (FIG. 1), thus protecting it from exposure to the elements. The flap 29 is flexibly repositionable so as to provide access to the enclosing means 25 as needed.

A shoulder strap means 40 interconnects the front and back packs, preferably fabricated from a material having a higher tensile strength relative to the material of the outer shell, 25 and 30. The shoulder strap means 40 includes a pair of straps 45 secured to the enclosing means 20 of the each of the packs 20 and 30. Preferably the straps 45 extend between the enclosing means 25, that is, each strap 45 is securely fastened by sewing or other fastening means to the enclosing means 25. In prior art pack devices, the straps are usually fastened to the fabric of the proximal wall wall 22 or the peripheral wall 24, or to the seam formed where these two walls meet. The later prior art construction is weak and tends to allow the strap 45 to pull-out under severe duty, such as in carrying tools in the pack. The present novel and preferred construction provides added strength and prevents ripping of the outer shell 21. The shoulder straps 45 are fabricated of a flexible material having a high tensile strength relative to the material of the outer shell 21. Preferably they are made of high strength nylon webbing. The straps 45 can be constructed to any desired fixed length, depending on the approximate size of the intended wearer of the double pack device. The shoulder strap means 40 preferably includes an outer shell casing means 43 that covers the portion of the shoulder straps 45 that extends freely between the two packs (FIG. 1). An interior padding means 41 is preferably positioned within each of the casing means 43 and is thereby supported and held in place between the straps 45 and the shoulder of the wearer.

Figure 4:
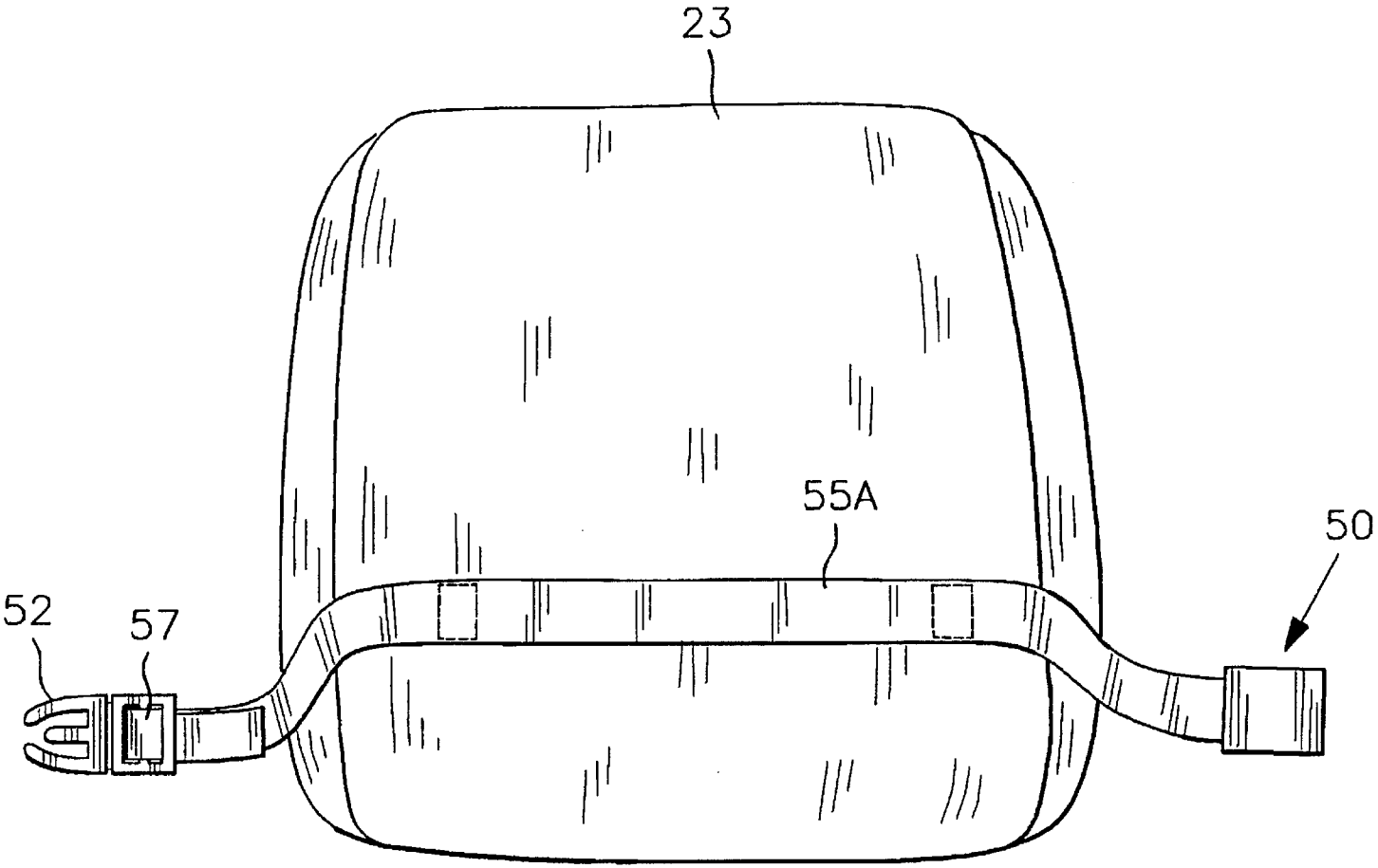
FIG. 4 is a front elevational view thereof.

Side strap means 50 are preferably positioned on each side of the packs so as to provide a means by which to interconnect the front 20 and back 30 packs along the sides of the wearer's body. The side strap means 50 includes a first 55A and a second 55B strap portion that are preferably constructed of the same material as the shoulder straps 45, although another flexible material with a high tensile strength relative to the material of the outer shell may alternately be utilized. There are numerous possible embodiments of the side straps means 50 that can be incorporated successfully within the scope of the present invention. In one preferred embodiment, the first strap portion 55A is a single, unbroken strap that extends across and is secured to either the proximal or the distal wall of the front pack 20 so that the terminal ends of the strap 55A hang freely from opposing sides of the pack, as illustrated in FIG. 4 where the embodiment shows that one of the packs has the side straps, as a single unbroken strap across the distal wall, and the other pack shows the side straps as a single unbroken strap across the proximal wall of the pack. Alternately, a pair of first strap portions 55A may be implemented, as illustrated in FIG. 1. Likewise, the second strap portion 55B preferably consists of a single strap conducted across the proximal or distal wall of the second pack 30, as best shown in FIG. 1. This construction provides the maximum possible strength and resistance to tearing or pull-out, and forms a continuous circle of strapping for maximum strength.

In another possible embodiment, two first strap portions 55A are provided, one portion on each opposing side of the front pack 20 (FIG. 1). The strap portions 55A are secured to the enclosing means 25 of the front pack 20, for improved strength, i.e., resistance to attachment failure. In this embodiment, two second strap portions 55B are also provided and secured to the enclosing means 25 of the back pack 30 in the same manner. In these embodiments, a two-part snap-in attachment means 52 is connected to the free ends 56 of each strap portion 55A and 55B, thus allowing the strap portions to be quickly engaged and disengaged with one another as desired. A strap length adjustment means 57 is preferably integral with the two-pan snap-in attachment means 52 It should be noted that there are numerous possible embodiments of both the two-part snap-in attachment means 52 and the length adjustment means 57 that are well known in the art and can be successfully implemented within the scope of the present invention.

Preferably, an exterior pocket 36 is positioned on the distal shell wall 23 of at least one of the packs. The pocket 36 is of a size appropriate for receiving a drinking liquid container 37. Preferably, the container has a flexible drinking tube 38 sufficient in length to reach from the bottom of the container to the mouth of the wearer. As illustrated in FIG. 1, the drinking tube 38 is preferably removably attached to one of the shoulder strap means 40 so that it remains stationary. In this embodiment, the casing 43 of the shoulder strap means 40 has at least one hold-down tab 46 attached to it. The hold-down tabs 46 are designed to removably engage around the drinking tube 38, thus fastening the tube to the strap means 40. Preferably, the hold-down tabs 46 utilize a two-pan mating fastener, such as VELCRO®, to removably engage the drinking tube 38. The drinking tube 38 preferably includes a removable cap 39 for closing the tube when not in use.

In one embodiment, a plurality of holder means 26 are positioned on an interior surface 22B of an interior wall, said wall being either an interior surface 22B of the proximal wall 22, or an interior wall adjacent to the proximal wall 22 for enclosing the padding 22A, the holder means 26 being of a size and shape to removably receive a plurality of tools 11 or other applicable items. There are numerous possible embodiments of the holder means 26 which can be successfully implemented within the scope of the present invention. In one preferred embodiment, illustrated in FIG. 1, the holder means 26 consists of a plurality of pockets 26 and hold-down tabs 26A attached to the inner surface 22B, each hold-down tab 26A positioned above each pocket 26. Thus, as illustrated, a tool 11 is positioned in each pocket and retained by the corresponding hold-down tab.

Thus, to properly position and wear the double pack device, the wearer's head is simply inserted between the two shoulder strap means 40 so that one shoulder strap means 40 rests on each of the wearers shoulders. The interior padding means 41 is positioned between the wearer's shoulders and the shoulder straps 45, thus preventing the straps 45 from digging into the wearer's skin or otherwise injuring or fatiguing the shoulders. When the shoulder strap means 40 are properly positioned on the wearer's shoulders, the front pack 20 is in contact with the front of the wearer's body and the back pack 30 is in contact with the back of the wearer's body. The side strap means 50 can then be employed to secure the packs around the sides of the wearer's body and keep them in close contact with the wearer. In the preferred embodiments described above, the side strap portions 55A and 55B are easily and quickly engaged around the wearer by simply interconnecting the two-part snap- in attachment means 52. Once the side strap means 50 are secured around the wearer's sides, the strap length adjustment means 57 is used to adjustably draw the proximal shell walls 22 of both packs 20 and 30 into firm contact with the body of the wearer. Depending on the intended use of the double pack device, the side strap means 50 may include a single set of side strap portions 55A and 55B on each side of the packs, or, for more fully holding the proximal shell walls 22 against the body, multiple sets of strap portions may be provided on each side.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A double pack device worn by a person for carrying items, the device comprising:

a front pack and an interconnected back pack, each of the packs having an outer shell of flexible non-self-supporting material comprising a proximal shell wall contacting the body of the person and a distal shell wall, the shell walls spaced apart and connected by a peripheral wall, the outer shell defining at least one interior space for removably containing and carrying items therein, wherein the peripheral wall has a separable enclosing means accessing the at least one interior space;

a shoulder strap means securely interconnected with the enclosing means of the back pack and the front pack, and an adjustable side strap means, both Strap means interconnecting the two packs, wherein the strap means are fabricated of a flexible material having a higher tensile strength relative to the material of the outer shell; whereby the shoulder strap means is supported by the shoulders of the person thereby positioning the front pack in contact with a front of the person and the back pack in contact with a back of the person and the side strap means, and a strap length adjustment means, configured for drawing the proximal shell walls into firm contact with the body of the person.

2. The device of claim 1 further comprising an exterior pocket on at least one of the distal shell walls, the pocket receiving a drinking liquid container, the container having a flexible drinking tube sufficient in length to reach from a bottom surface of the container to the mouth of the person, the drinking tube removably attached to one of the shoulder strap means.

3. The device of claim 2 wherein the shoulder strap means further comprises at least one hold-down tab attached thereto removably engaging the drinking tube and fastening to the strap means by a two-part mating fastener.

4. The device of claim 3 wherein the flexible drinking tube has an enlarged distal end means configured to engage a cap enclosing the tube and, with the cap removed, to be engaged by a mouth of the person, thereby providing means for drinking the liquid by mouth suction.

5. The device of claim 1 further comprising a plurality of holder means on an interior surface of the outer shell, the holder means of a size and shape to receive a plurality of tools removably therein.

6. The device of claim 5 wherein the proximal shell wall of at least one of the packs further comprises padding means interconnected therewith and adapted to be positioned between the plurality of tools and the body of the person.

7. The device of claim 5 wherein the plurality of holder means comprises a plurality of pockets attached to the outer shell and a plurality of hold-down tabs attached thereto, one of the hold-down tabs positioned above each one of the plurality of pockets, each of the hold-down tabs retaining one of the plurality of tools in one of the plurality of pockets.

8. The device of claim 1 further comprising at least one light reflecting means fixed to at least one of the distal shell walls on an outer surface thereof.

9. The device of claim 1 wherein the shoulder strap means comprises a shoulder strap positioned over each shoulder, a casing means covering each of the shoulder straps, and an interior padding means positioned within each of the casing means between the shoulder strap and the shoulder of the person.

10. The device of claim 1 wherein the enclosing means extends continuously along a first side portion, over a top portion, and along an opposing second side portion of the peripheral wall.

11. The device of claim 10 wherein the enclosing means comprises a zipper medially attached to the side and top portions of the peripheral wall.

12. The device of claim 10 wherein the side strap means comprises a pair of first strap portions securely fixed to and extending from opposing sides of the enclosing means of the front pack and a pair of second strap portions fixed to and extending from opposing sides of the enclosing means of the back pack.

13. The device of claim 12 wherein the first strap portions are joined as a continuous strap fixed to the distal shell wall of the front pack, encompassing the front pack.

14. The device of claim 12 wherein the second strap portions are joined as a continuous strap fixed to the proximal shell wall of the back pack.

15. The device of claim 12 wherein the first strap portions are joined as a continuous strap fixed to the distal shell wall of the front pack, encompassing the front pack and the second strap portions are joined as a continuous strap fixed to the proximal shell wall of the back pack, the first and the second strap portions thereby, when joined, form a complete encirclement of the front pack and the proximal shell wall of the back pack.

16. The device of claim 15 wherein the strap portions are removably engageable by a two part snap-in attachment means, thereby facilitating mounting the device on and removing the device from the body of the person.

17. The device of claim 1 further comprising a water-resistant flexible flap normally positioned for overlapping the enclosing means and flexibly repositionable providing access thereto.

* * * * *